United States Patent [19]

Fields

[11] Patent Number: 4,705,054

[45] Date of Patent: Nov. 10, 1987

[54] ULTRASONIC RADIATOR CLEANING SYSTEM

[76] Inventor: John T. Fields, 810 E. 6th St., Tulsa, Okla. 74120

[21] Appl. No.: 765,847

[22] Filed: Aug. 15, 1985

[51] Int. Cl.[4] ..... B08B 3/12

[52] U.S. Cl. ..... 134/57 R; 134/1; 134/184

[58] Field of Search ..... 134/1, 184, 57 R, 186, 134/169 R, 169 A; 68/3 SS; 366/127, 117, 118

[56] References Cited

U.S. PATENT DOCUMENTS

| | | | |
|---|---|---|---|
| 2,831,785 | 4/1958 | Kearney | 68/3 SS X |
| 2,922,428 | 1/1960 | Wampler et al. | 134/1 X |
| 3,052,244 | 9/1962 | Gley | 134/1 X |
| 3,240,963 | 3/1966 | Sasaki | 134/1 X |
| 3,319,638 | 5/1967 | Ellison | 134/169 R X |
| 4,372,787 | 2/1983 | Fields et al. | 134/184 X |
| 4,585,019 | 4/1986 | Jacobson | 134/57 R |

*Primary Examiner*—Philip R. Coe

*Attorney, Agent, or Firm*—Head & Johnson

[57] ABSTRACT

A radiator having a header is cleaned by at least partially immersing the radiator in a cleaning liquid and then applying ultrasonic energy to the liquid. The cleaning liquid is held in a container which has a sludge pit along the bottom thereof. An ultrasonic transducer is mounted on a carriage and is movable above the sludge pit. A rack is provided above the movable transducer for holding or supporting radiators. The movement of the ultrasonic transducer is controlled in accordance with the width of the radiator being cleaned.

3 Claims, 6 Drawing Figures

ULTRASONIC RADIATOR CLEANING SYSTEM

BACKGROUND OF THE INVENTION

1. Field of Invention.

This invention relates to improvements in methods and means for cleaning radiators and more particularly, but not by way of limitation, to an ultrasonic method and means for cleaning radiators.

2. Discription of Prior Disclosures.

Radiators of all sizes are in wide spread use today in many areas such as the conventional vehicle or truck radiators, industrial radiators and the like. During utilization of these radiators, the header members which normally support the outer ends of the heat exchange tubes of the radiator, frequently become encrusted with residue material from the fluids normally utilized in connection with the radiator. This accumulation of residue and the like hinders the efficient operations of the radiator and, as a result, it is common practice to clean the radiators for improving the operational performance thereof. A method for using ultrasonic transducers is described in U.S. Pat. No. 4,372,787 entitled "Method For Ultrasonic Cleaning Of Radiators", issued Feb. 8, 1983. The method described in that patent is being widely used, however, it is not without certain drawbacks. For example, the ultrasonic transducers are fixed and there is the problem of accumulation of sludge on the transducers.

SUMMARY OF THE INVENTION

The present invention contemplates a novel method and means for quickly and efficiently cleaning radiators in a manner for overcoming the foregoing disadvantages. The novel invention comprises an ultrasonic cleaning method which comprises a suitable housing which is preferably rectangular in shape. Along the bottom of the housing there is provided a sludge pit e.g., 4 inches deep and 7 inches wide for collecting sludge. A carriage supporting an ultrasonic transducer is movable above the sludge pit and along the bottom of the housing or tank. There is a radiator support rack above the ultrasonic transducer. Adjustable means are provided to control the length or width of movement of the transducer along the bottom of the tank. If only one radiator is being cleaned, the movement would be controlled by the width of the radiator. A suitable cleaning liquid, which is a technically compounded blend of the proper chemicals for performing the cleaning operations, is placed in the housing and surrounds the transducer means and the lower end of the radiator when placed in the tank. When cleaning the radiator a heating means is provided for heating the cleaning liquid to a preselected temperature. A (or radiators) radiator is then lowered, header down, onto the radiator rack. Stop means are adjusted to give the transducer means its desired or selected travel path. Then the transducer means is activated by the ultrasonic generator means for converting electrical energy into mechanical energy. At the same time the motor for moving the transducer means is activated and together with the stops and control means causes the transducer means to travel back and forth between the two stop means. As the sludge is cleaned from the radiator, it falls downwardly and a part of it may fall on the transducer means. However, inasmuch as the transducer is being moved while in the activated state, the vibrations causes the sludge to fall off the trailing end and into the sludge pit.

In another embodiment, two transducer means are involved. One is fixed near one end of the housing or tank in a vertical position and a second one is mounted on a traveling rack, also in a vertical position. The radiator to be cleaned is mounted on a rack between the two vertical transducer means. The movable transducer means is, of course, adjustable to accomodate different size radiators.

DETAILED DESCRIPTION OF THE PREFERRED EMBODIMENT

Figure 1:
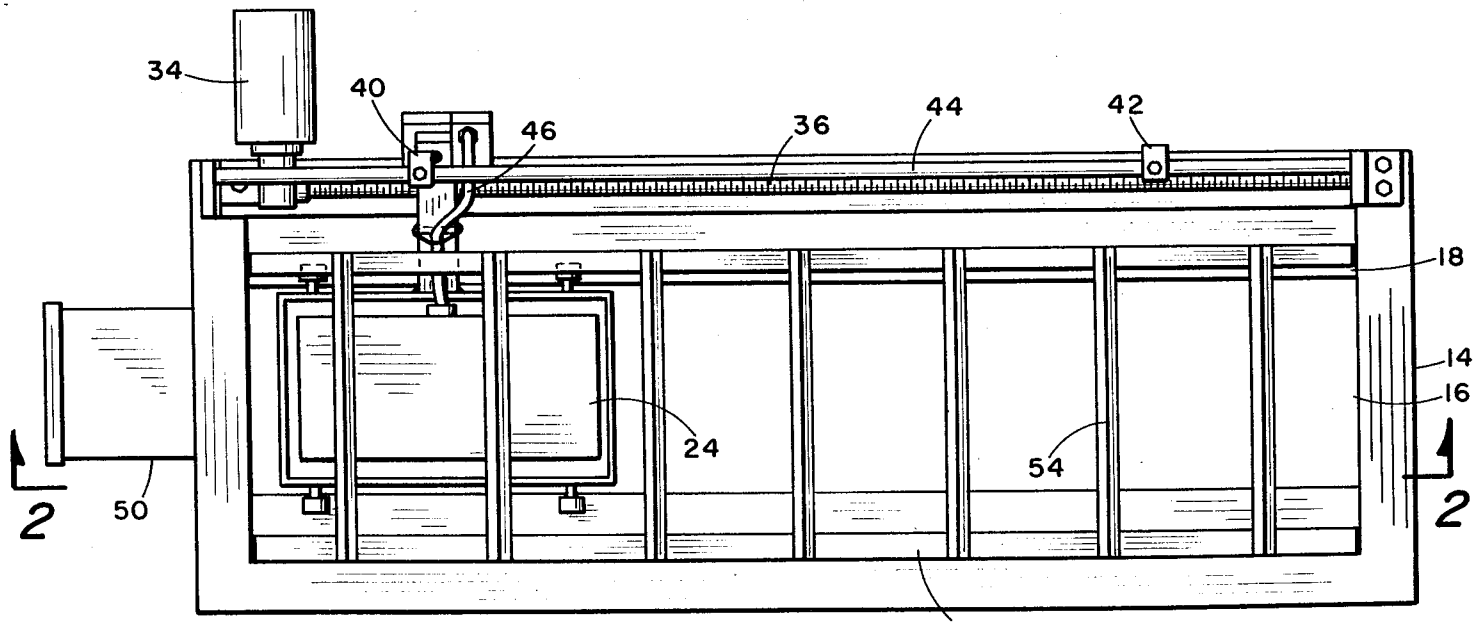
FIG. 1 is a plan view of an ultrasonic radiator cleaning apparatus embodying the invention.
Figure 2:
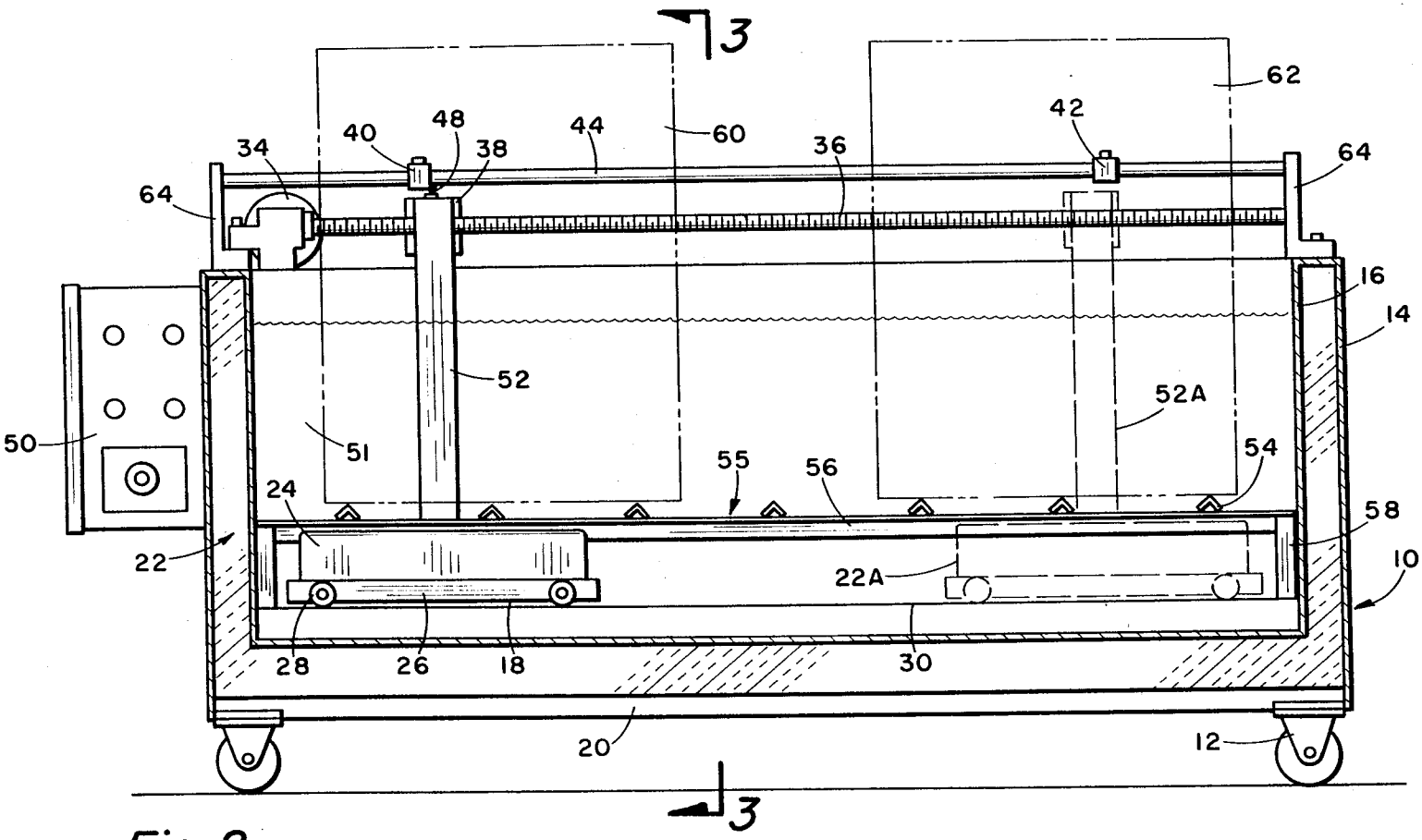
FIG. 2 is plan view taken along the line 2—2 of FIG. 1 and is an elevation view.
Figure 3:
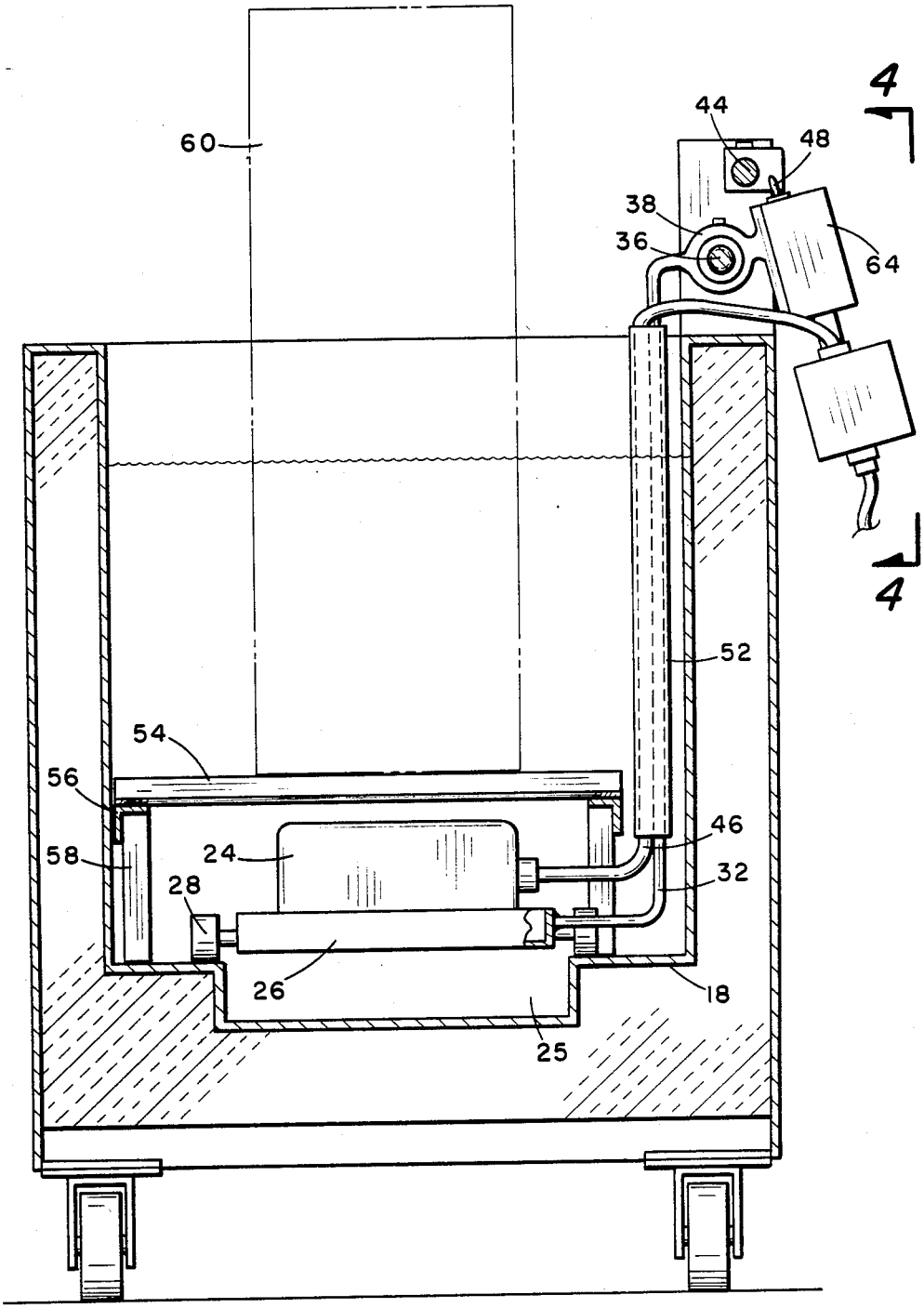
FIG. 3 is a view taken along the line 3—3 of FIG. 2.
Figure 5:
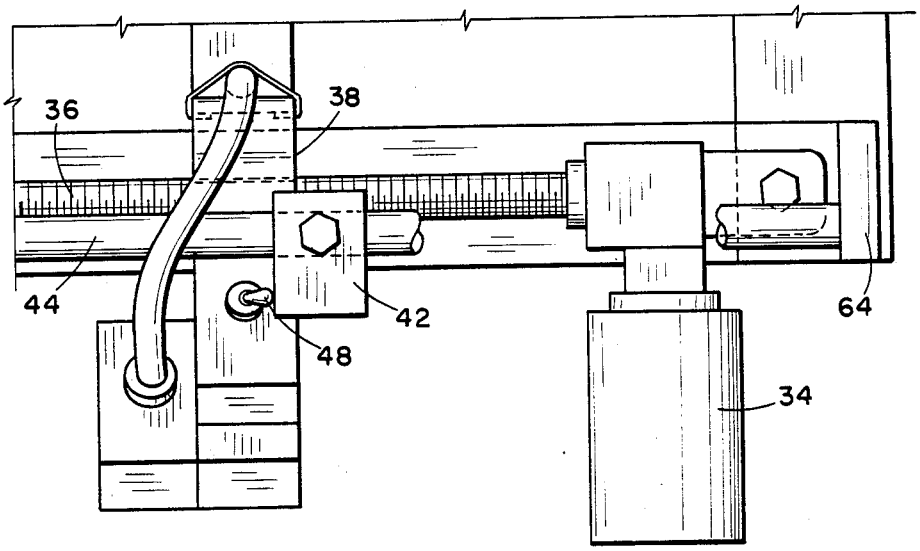
FIG. 5 is a view taken along the line 5—5 of FIG. 4.

Attention is now directed to the drawings and particularly FIGS. 1 and 2. Shown therein is an ultrasonic radiator cleaning apparatus. This includes a double-wall tank or housing having an outer wall 14 and inner wall 16 with insulation 22 therebetween. The housing can be mounted on wheels 12 for easy movement from one location to another. The tank has a bottom plate 18 and a bottom 20. As can be seen in the drawings and especially FIG. 1, the configuration of the housing is preferably rectangular. As shown in FIG. 3, there is a sludge pit 25 which runs the length of the housing as shown in FIG. 1.

Means will now be discussed for moving the transducer 24 from one position to another. The transducer means 24 is activated by an ultrasonic generator means (not shown) for converting electrical energy into mechanical energy in a known manner. The transducer means 24 is preferably an immersible transducer of the type manufactured and sold by Branson Cleaning Equipment Company, Parrott Drive, Shelton, Conn. The ultra-sonic generator can be of a type also manufactured and sold by Branson Cleaning Equipment Company. The transducer means 24 is mounted on a carriage 26 having rollers 28 which move along track or path 30.

As shown in FIG. 3, a drive rod 32 is connected to carriage 26. The upper end of drive rod 32 is secured to traveling block 38 which has internal threads which are screwed onto the threads of lead screw 36 which is connected between reversable motor 34 and the end support 64.

A line 46 connects the ultrasonic generator to the transducer means 24 in a known manner. The upright portion of line 46 and the upright portion of drive rod 32 are in housing 52.

As shown in FIG. 2, transducer means 24 can be in the position shown in the solid lines on the left or it can be moved to a second advanced position indicated by dashed lines 22A and 52A and alternatively moved in different directions between the two portions.

Figure 4:
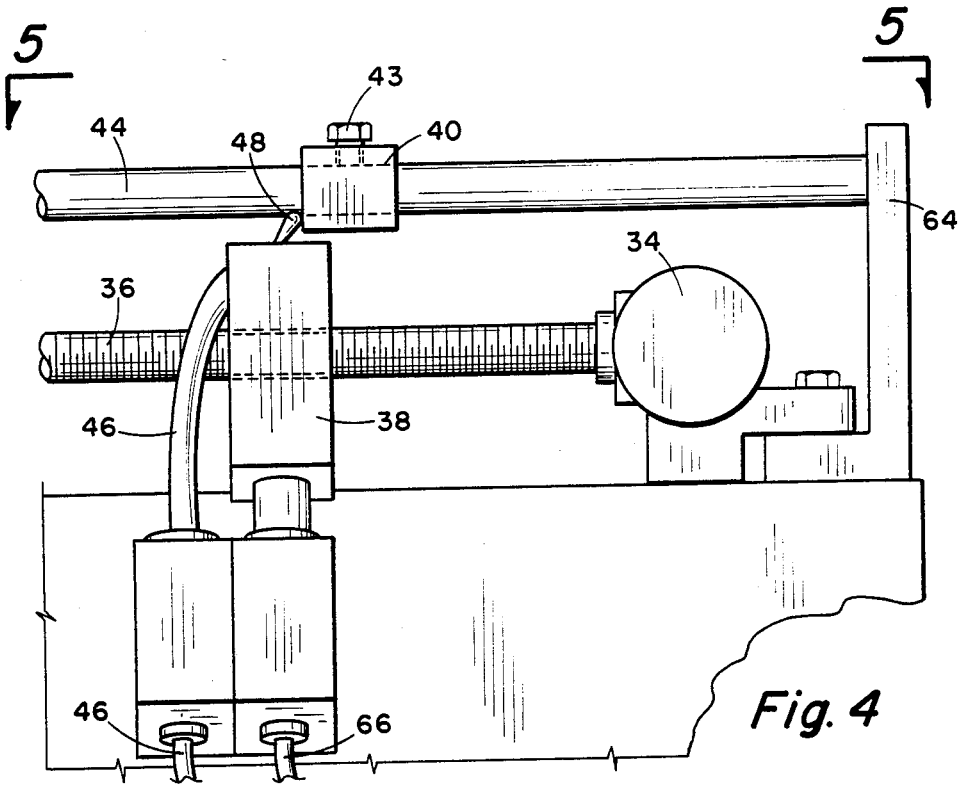
FIG. 4 is a view taken along the line 4—4 of FIG. 3.

A reversable motor 34 rotates screw 36 and in doing so, causes traveling block 38 to move either left or right and carry with it the drive rod 32 which drives the carriage 26 which moves the transducer means 24 alternately from one position to another. There are means provided to determine the travel of the transducer means. This includes a first limiting stop 40 and a second limiting stop 42 mounted on a rod 44 which is supported from end members 64 from the housing or tank of the cleaning portion of the device. These stops 40 and 42 can be moved to any selected position. A toggle switch 48 is provided on traveling block 38. When the switch contacts one of the stops, it moved to a second position. This second position causes the motor 34 to reverse, thus driving the screw 36 in the other direction. This, in turn, moves the traveling block 38, carriage 26 and transducer means 24 in the opposite direction. It continues moving in this opposite direction until it again encounters the second limiting stop means 42, at which time the toggle switch 48 is again switched to another position which reverses the motor 34. Leads 66, shown in FIG. 4, go from the traveling block 38 to the motor control panel 50. The motor control panel 50 then directs the motor 34 to reverse itself. Means are provided to mount the radiators above the movable transducer means. This includes a removable rack 55 which includes end support members 58 and two longitudinal support bars 56 which run the entire length of the tank and cross-members 54 upon which the radiator sits. As shown in FIG. 2 and indicated by the broken lines there is a first radiator 60 and a second radiator 62 sitting on the cross-members 54.

In operation I start with the rack 55 mounted above the transducer means 24 as shown in FIG. 2. I then fill the tank 10 with a cleaning fluid to the desired level and put in radiators 60 and 62 or whatever number is possible. I then apply heat using means not shown in well known manner to heat the cleaning fluids to a selected temperature. I then activate transducer means 24 so that it agitates the cleaning liquid surrounding the radiator portion emerged therein. At the same time, I activate motor 34 and it causes the carriage 26 to move to the right to the position shown at 22A which is under second radiator 62. All the time the cleaning liquid is being agitated that portion of the radiator emerged in the cleaning fluid is quickly and efficiently cleaned of all residue or the like which is deposited on the radiator. The accumulated deposits are removed even from hidden crevices and the like resulting in a substantially new looking radiator header upon removal of the radiator from the cleaning liquid 51. During this time, the carriage moves to the right until it gets to the position indicated by upright members 52A and dashed line where the limit switch 48 encounters limiting stop 42. This sends a signal to control panel 50 which reverses the direction of motor 34 and causes the transducer means 24 to be carried back to the original starting position as indicated in FIG. 2. There the toggle switch 48 again encounters another limiting stop 40 which again reverses the motor 24 to drive it back in the opposite direction. This travel in alternate directions continues during the cleaning operations. The sludge and deposits from the radiator drops downwardly and will eventually accumulate in the sludge pit. Some of the sludge falls on top of the transducer means 24. However, as it is moving and is vibrating rather highly, the sludge will fall off the trailing end of the transducer means and fall into the sludge pit. The sludge pit is typically about 4" deep and 7" wide which holds a large quantity of sludge. It has been found that it will need to be cleaned only about once every eight months or so. I have what may be called a self-cleaning transducer means. (Cleaning fluid can be removed through outlet port means not shown.) I have built one of these cleaning devices as illustrated in FIGS. 1, 2, 3, 4 and 5. The transducer is about 20" square and the tank was sufficiently large so that I can place two large truck radiators in there easily and up to 8 or 9 automobile radiator headers in there at one time. By moving the transducer means as I have indicated, I can clean all of these radiators at one time in about 10 minutes with only one transducer means. Inasmuch as I keep the sludge off the top, I have no arcing over problem.

Figure 6:
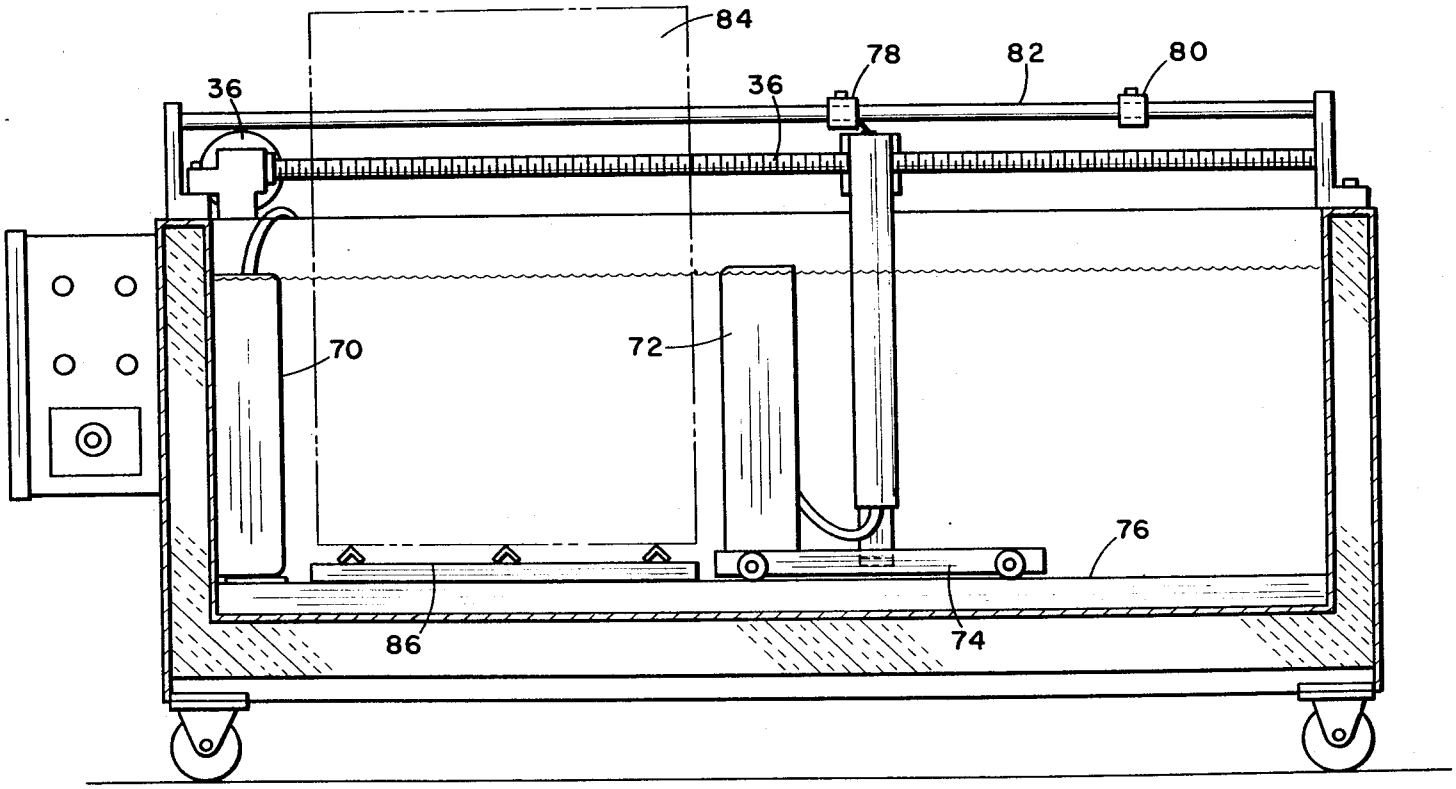
FIG. 6 is a side elevational view of a different embodiment showing two vertically erected ultrasonic transducers, one fixed and the other movable.

Attention is next directed to FIG. 6 which shows another embodiment of my invention. Shown thereon is a first fixed transducer 70 and a second movable transducer 72. A carriage 74 supports upright transducer means 72 and moves along a track means 76 by a support rod not shown similar to drive rod 32 shown in FIG. 3. The travel of carriage 74 is determined by the positions of first stop 78 and second stop 80 which is mounted on a rod 82. A radiator 84 is mounted on a radiator rack 86 which may be similar to rack 55 of FIG. 2. If one wishes, one may put in the radiator 84 and then position the movable transducer means 72 to be in a position adjacent the radiator header of radiator 84. Then one can deactivate the motor 36 and perform the cleaning operations with the two transducers 70 and 72 in the positions shown in FIG. 6. One can also cause transducer means 72 to alternately travel between stops 78 and 80.

While this invention has been described with a certain degree of particularity, it is manifest than many changes may be made in the details of construction in the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed:

1. An apparatus for cleaning radiators comprising:

a tank for holding cleaning fluid and having a longitudinal axis;

a sludge pit in the bottom of said tank and being of less width than the tank but of approximately the same length, there being formed two parallel shoulder members in the bottom of said tank at the top of said sludge pit, there is one such shoulder member on each side of said sludge pit;

a radiator rack supported above the bottom of said tank and extending the full length thereof and extending over substantially all of the sludge pit;

a roller on each of said shoulders;

carriage means supported by said rollers, said carriage means supporting an energy source over said sludge pit;

means for automatically moving said carrier means and said energy source between two selected positions along a path on said shoulders within said container.

2. An apparatus as defined in claim 1 in which said means for automatically moving said carriage means and said energy source includes a reversible drive motor, a rod mounted above said tank and driven by said motor, limiting stops mounted on said rod;

a traveling block on said rod;

an arm connecting said traveling block to said carriage means.

3. An apparatus as defined in claim 2 including control means to alternately move said traveling block between two selected positions.

* * * * *